US005207166A

United States Patent [19]

Eichhorn

[11] Patent Number: 5,207,166

[45] Date of Patent: May 4, 1993

[54] METHOD AND APPARATUS FOR MAKING PANTYHOSE WITH A COMFORT GUSSET

[75] Inventor: Rudolf Eichhorn, Altkrautheim, Fed. Rep. of Germany

[73] Assignee: Detexomat Machinery Limited, Buckinghamshire, England

[21] Appl. No.: 801,650

[22] Filed: Dec. 2, 1991

Related U.S. Application Data

[63] Continuation of Ser. No. 615,892, Nov. 20, 1990, abandoned.

[30] Foreign Application Priority Data

Nov. 23, 1989 [DE] Fed. Rep. of Germany ..... 3938768

[51] Int. Cl.[5] ..... D05B 97/00

[52] U.S. Cl. ..... 112/262.2; 112/121.15; 112/155

[58] Field of Search ..... 112/262.2, 262.1, 121.15, 112/262.3, 121.11, 121.12, 2, 155; 223/112, 42; 2/409, 408, 406

[56] References Cited

U.S. PATENT DOCUMENTS

| | | | |
|---|---|---|---|
| 4,101,982 | 7/1978 | Muller | 2/409 |
| 4,188,898 | 4/1980 | Bell, Jr. et al. | 112/121.15 Y |
| 4,224,885 | 9/1980 | Takatori | 112/121.15 |
| 4,333,408 | 12/1982 | Maselli et al. | 112/121.15 |
| 4,524,705 | 6/1985 | Humphreys | 112/121.15 |
| 4,541,351 | 9/1985 | Horita et al. | 112/262.2 |
| 4,549,493 | 10/1985 | Gazzarrini | 112/121.15 |
| 4,704,976 | 11/1987 | London et al. | 112/262.2 |
| 4,862,815 | 9/1989 | Thurner et al. | 112/262.2 |

FOREIGN PATENT DOCUMENTS

| | | |
|---|---|---|
| 2812921 | 12/1978 | Fed. Rep. of Germany . |
| 3506316 | 9/1986 | Fed. Rep. of Germany . |
| 2094616 | 6/1982 | United Kingdom . |
| 2214054 | 1/1989 | United Kingdom . |

*Primary Examiner*—Peter Nerbun
*Attorney, Agent, or Firm*—Dority & Manning

[57] ABSTRACT

In order to insert into tights comfort gussets which reach to the waistband of the tights, a line closing apparatus for the machine sewing of a pair of tights is used which has an extra form provided in the sets of forms of the apparatus, and a tubular prefabricated comfort gusset is pulled onto the extra form. The tubular gusset is cut open together with two tubular prefabricated stocking leg portions and is connected to the stocking leg portions when seaming the legs together.

9 Claims, 8 Drawing Sheets

METHOD AND APPARATUS FOR MAKING PANTYHOSE WITH A COMFORT GUSSET

This is a continuation of application Ser. No. 615,892, filed Nov. 20, 1990, now abandoned.

The invention relates to a method and an apparatus for the machine sewing of a pair of tights or pantihose with a comfort gusset reaching at least from the crotch across the seat portion to the waistband. The apparatus for carrying out the method comprises forms to hold two prefabricated tubular stocking portions of the tights and a plurality of processing stations past which the forms can be moved and of which at least one station comprises a cutting device and at least one a sewing device.

An apparatus of the kind mentioned above is known, for example, from DE-OS 28 12 921. Only tights which are reinforced in the crotch by a conventional small gusset can be produced fully by machine on the known sewing apparatus of this kind. Tights for larger ladies, in which the necessary larger body width is provided by a so-called "half" comfort gusset —which reaches at least from the crotch over the seat portion to the waistband of the tights, or even by a "whole" comfort gusset— which is continuous from the back waistband, across the seat portion, through the crotch and extends to the front of the abdomen portion of the waistband— hitherto had to have the comfort gusset sewn in by hand.

It is an object of the invention to eliminate the above-mentioned manufacturing disadvantages and to provide a method and an apparatus for carrying out the method whereby even the larger comfort gussets can be incorporated in the tights by machine.

The problem posed is solved by the method according to the present invention. The invention provides a method for the machine sewing of a pair of tights or pantihose having a comfort gusset extending at least from the crotch of the garment, over the seat portion and to the waistband, characterized by the following successive steps:

a) prefabricating a comfort gusset in the form of a tubular knitted part beginning with an elasticated or waistband portion;

b) closing the end of the flattened tubular knitted part remote from its said portion by means of a seam;

c) pulling the tubular comfort gusset onto a form disposed between two other forms each receiving a stocking portion of the pair of tights in such a manner that the seam extends in a plane perpendicular to the planes of the forms which are parallel to one another;

d) subsequently seaming e.g. sewing the stocking portions to the tubular comfort gusset after a previous partial cutting open of the parts.

Apparatus for carrying out such a method, in accordance with this invention, has forms to hold two prefabricated tubular stocking portions and has a plurality of processing stations past which the forms can be moved, of which at least one station comprises a cutting device and at least one station a seaming device, and the apparatus is characterized in that disposed between the forms is a third form to mount the tubular prefabricated gusset element, the third form being arranged for joint movement with the other two forms.

For the incorporation of the comfort gusset in the tights by machine, according to this invention, the comfort gusset, like the two stocking portions of the tights, is prefabricated in the form of a tubular structure, preferably on a circular knitting machine. The gusset has a waistband portion, like the stocking portions. After making an open-ended tubular comfort gusset element, its end remote from the waistband is closed by means of a seam, for instance a convexly-curved seam. This prefabricated, bag-like, structure is then pulled onto the third form situated between the other two forms so that the closing seam of the comfort gusset extends in a plane which is perpendicular to the form plane. During the known step of cutting open the two stocking portions at a first processing station, the inter-posed comfort gusset is also cut open, according to this invention, up to a point short of its closing seam. At the following sewing stations, cut edges of the comfort gusset are then sewn to cut edges of the two stocking portions. For example, at a first sewing station, a seam is formed between one cut edge of the comfort gusset and at least one cut edge of one stocking portion and at a second sewing station, a seam is formed between the other cut edge of the comfort gusset and at least one cut edge of the other stocking portion.

The apparatus according to the invention may be differently embodied depending on whether a continuous or "whole" comfort gusset extending from the front waistband to the back waistband is to be fitted, or a half comfort gusset which is continuous only from the crotch area to the back waistband region. In the first case, the third form may be composed of two like and symmetrically arranged supporting arms, similar in many respects to the pair of forms provided for the two stocking portions. For handling of a half comfort gusset, which only has to be sewn to the two stocking portions as far as the crotch region of the tights, the third form may be made asymmetrical and have a co-pivotable supporting arm only at one side between supporting arms of the other two forms, while the other boundary portion of the form may consist of a stretching arm which is movable in the plane of the third form and which can be introduced into the tubular prefabricated comfort gusset. The stretching arm serves only to expand the tubular comfort gusset which has been pulled onto the other supporting arm, and, in a stretching position the stretching arm projects at least partially between two of the pairs of supporting arms of the other two forms in order to stretch the comfort gusset there with one part. This stretching arm may advantageously be "J" shaped, i.e. curved like a hockey stick or in a sickle-like manner. Beneficially, it will hove a rounded free end.

Further features and advantages of the invention can be seen from the following non-limiting description which is to be read in connection with the drawings which show apparatus constructed according to the invention.

Figure 1:
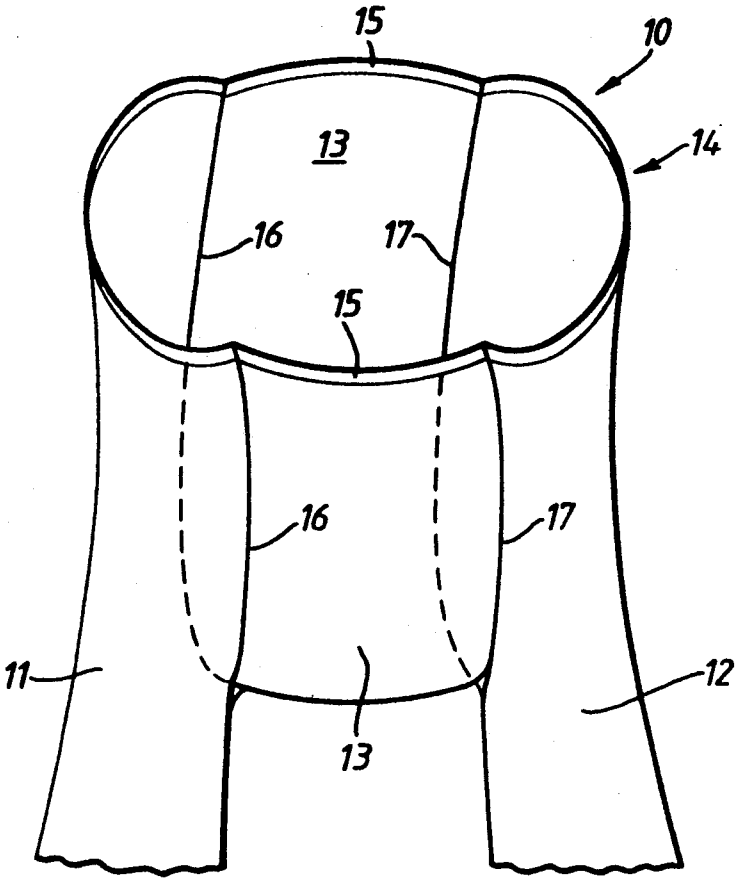
FIG. 1 shows a diagrammatic perspective illustration of the upper portion of a pair of tights or pantihose equipped with a continuous comfort gusset.

FIG. 1 shows the body portion of a pair of tights 10 which is formed from two like, tubular, prefabricated stocking portions 11 and 12 and a continuous comfort gusset 13. The comfort gusset 13 forms, with its elastic band beginning at 15 as seen in FIG. 3, both the front portion and the back portion of the waistband 14 of the pair of tights 10 and is connected along cut edges thereof by two continuous seams 16, 17 from the front waistband region to the back waistband region, to cut edges of the two stocking portions 11 and 12.

Figure 2:
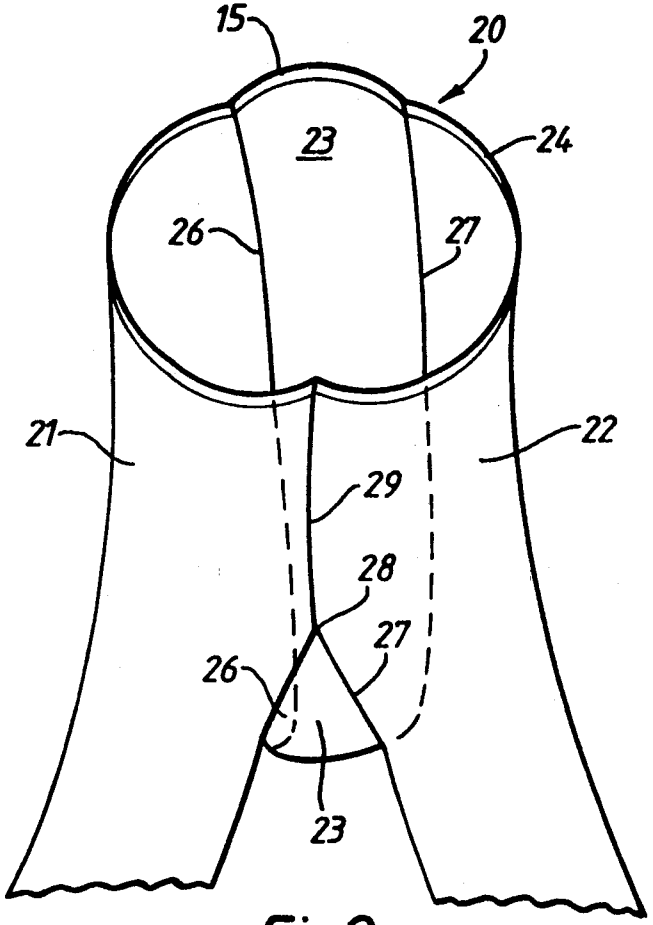
FIG. 2 shows a diagrammatic perspective illustration of the upper portion of a pair of tights or pantihose provided with a half comfort gusset.

FIG. 2 shows the body portion of a pair of tights 20 which consists of two like, tubular prefabricated stocking portions 21, 22 and a half comfort gusset 23. The half comfort gusset 23 extends only over the crotch and the seat portion of the pair of tights and forms with its elastic band 15, part of the waistband 24 of the pair of tights 20. This gusset occupies only the seat region. After the crotch of the pair of tights, the two connecting seams 26 and 27 converge and, at a point 28, merge into one seam 29 whereby cut edges of the two stocking portions 21 and 22 are connected to one another.

Figure 3:
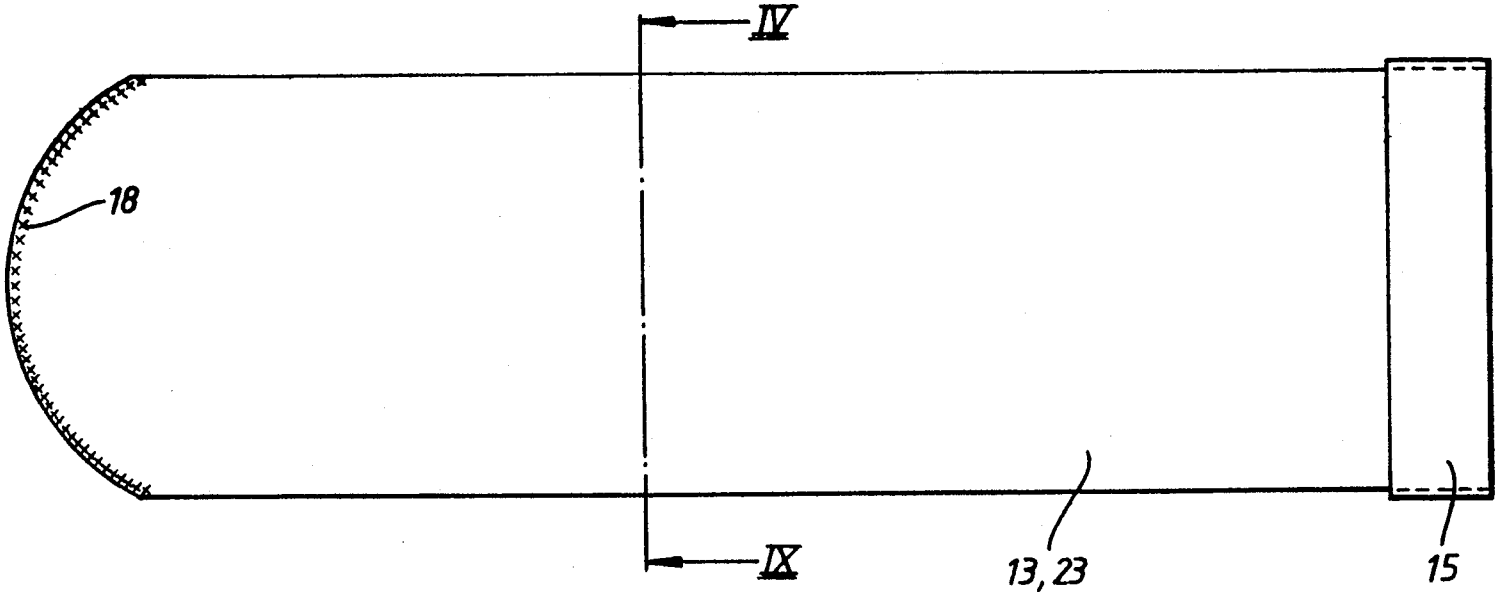
FIG. 3 shows a plan view of a prefabricated tubular comfort gusset laid flat.
Figure 4:
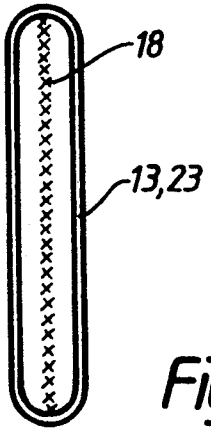
FIG. 4 shows a cross-section through the tubular comfort gusset on the line IV-IV in FIG. 3.

The comfort gussets 13, 23 are first prefabricated in an open-ended tubular form which can be seen from FIGS. 3 and 4, starting from an end band 15 which is kept elastic by incorporating rubber threads. The prefabricated tubular comfort gusset 13, 23 is closed at its terminal end by a seam 18 which, in this instance, extends in a convex curve.

Figure 5:
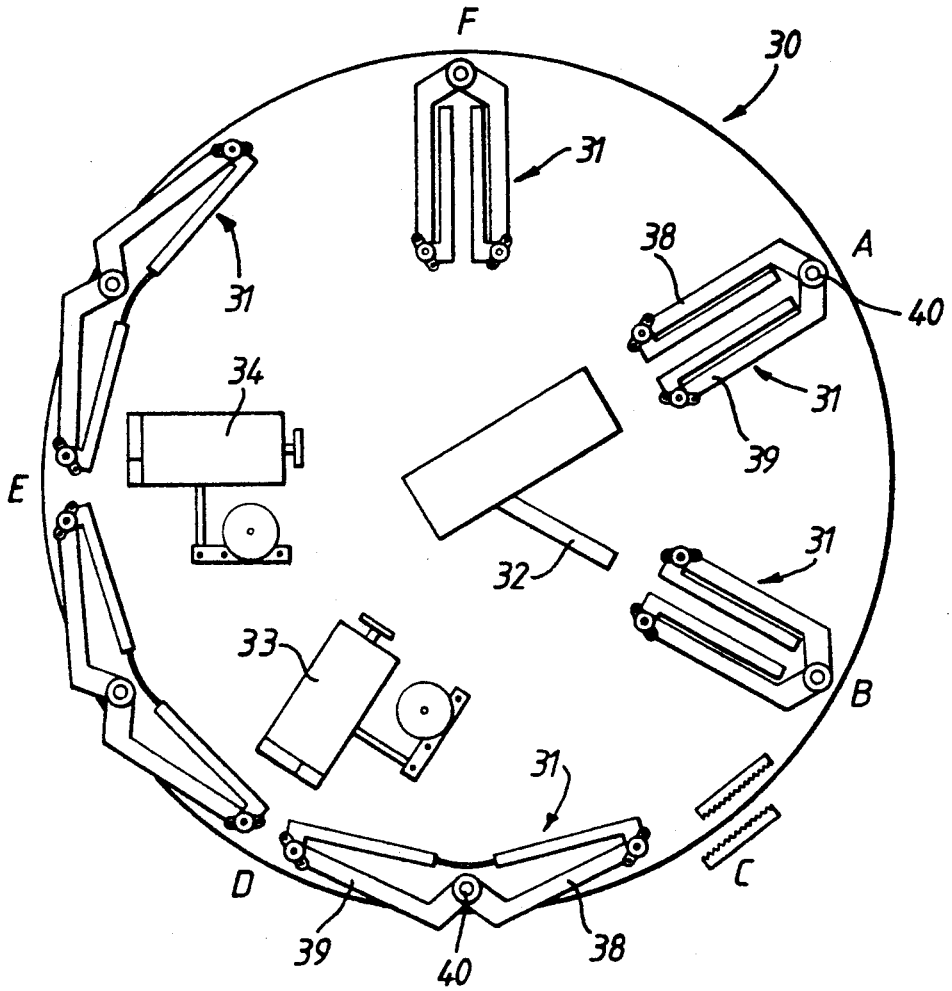
FIG. 5 shows a diagrammatic plan view of an apparatus embodying the invention for the machine sewing of tights or pantihose provided with comfort gussets.

In the diagrammatic plan view according to FIG. 5 of an apparatus 30 for the production of the tights 10 or 20 provided with the comfort gussets 13 or 23, six processing stations, A, B, C, D, E, F are indicated at which the prefabricated parts are processed successively to form the tights. The apparatus 30 is provided with sets of forms 31 which are movable from processing station to processing station and the construction of which will be explained in more detail below in connection with FIGS. 6 to 10. At the processing station A, the pulling of the prefabricated tubular stocking portions 11, 12 or 21, 22 and of the tubular prefabricated comfort gusset 13 or 23 onto the sets of forms 31 is effected. At the processing station B, a cutting open of the stretched parts is effected in the body region of the tights in each case. At the processing station C, the sets of forms are swung open in order to expose the cut edges of the portions of the tights suitably for the formation of connecting seams at the following two processing stations D and E. Finally, at the processing station F, the sets of forms 31 are closed again and the fully sewn tights are withdrawn from the sets of forms and from the apparatus. Of the processing tools, only a cutting device 32 and two sewing devices 33 and 34 are indicated in FIG. 5 for simplicity.

Figure 6:
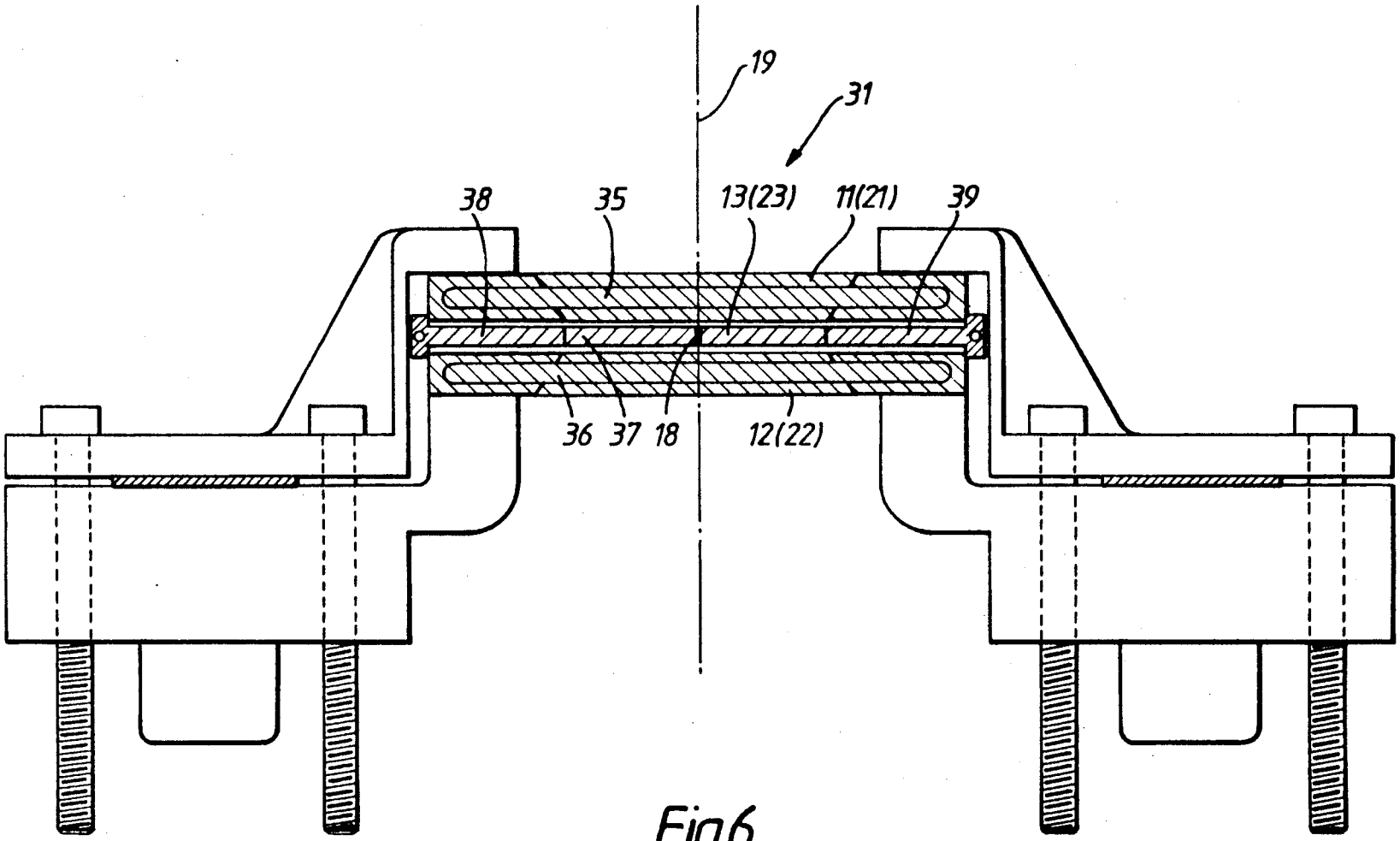
FIG. 6 shows a cross-section on the line VI—VI in FIG. 7 through a set of forms of the apparatus.
Figure 7:
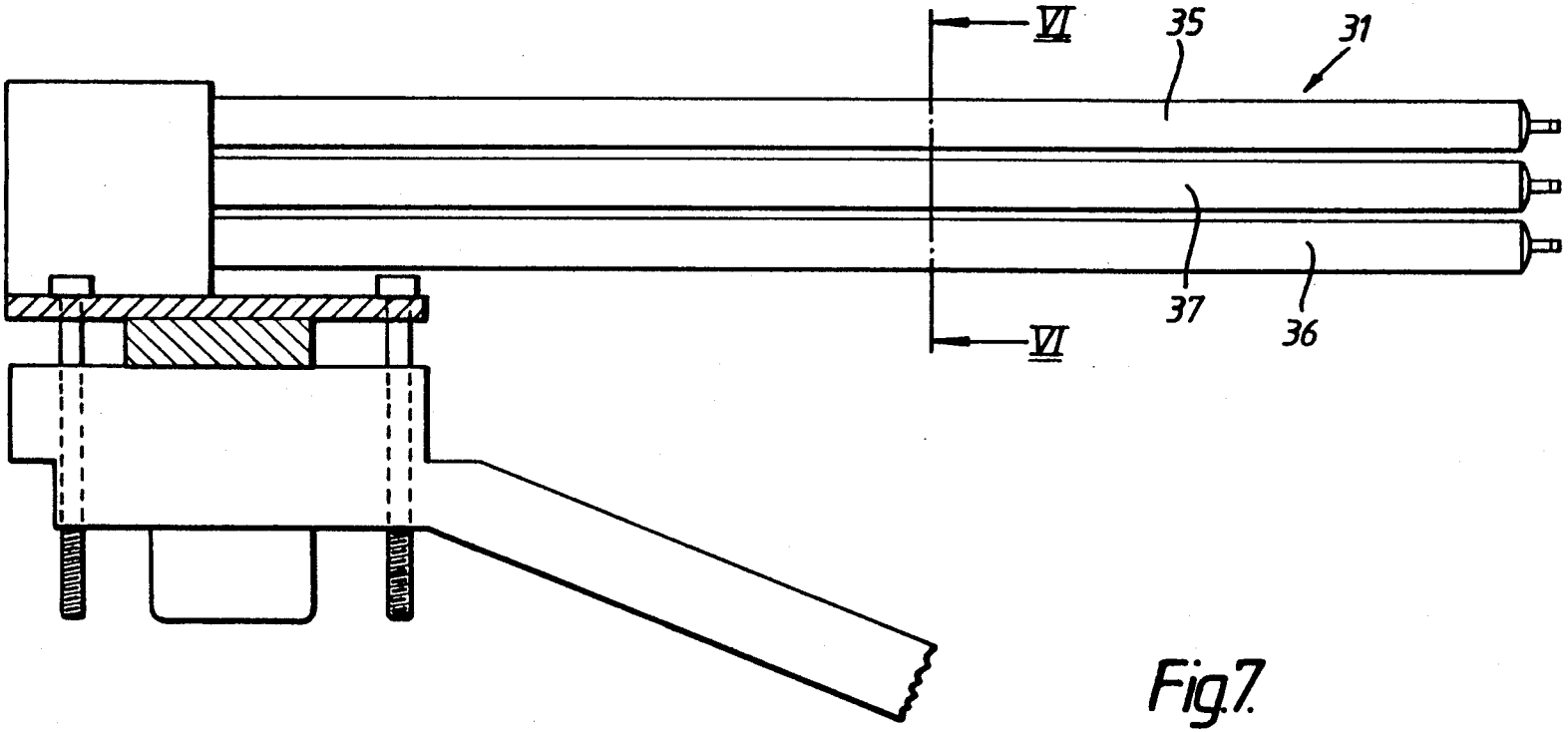
FIG. 7 shows a side view of a set of forms of the apparatus.

FIGS. 6 and 7 show a set of forms 31 which is adapted to form a pair of tights 10, that is to say for processing a continuous comfort gusset 13. The set of forms consists of an upper form 35, a lower form 36 and a third form 37 which is arranged between the upper and lower forms. According to FIG. 5, all three forms 35–37 are of bracket-like construction and each consist of two supporting arms 38 and 39 which are mounted for pivoting movement about a pin 40. The precise construction of these supporting arms, which simultaneously serve as clamping arms and can be coupled to spreading brackets, is of no interest here and is previously known, for example through relevant apparatus from the Japanese firm Takatori Machinery Works. Such apparatuses include Takatori line closers Models LC-240, LC-280 and LC-320; one such line closer is described in GB-A-1,339,365. Upper forms 35 and lower forms 36 are used to support, by pulling thereon the two tubular prefabricated stocking portions 11, 12 or 21, 22. In FIGS. 6 and 7, only the two supporting arms 38 and 39 of the third form 37, not previously known, are designated, on which a tubular prefabricated comfort gusset 13 or 23 according to FIG. 3 is to be stretched so that its closing seam 18 extends in a plane which, as indicated by a chain line 19, is directed perpendicular to the plane formed by the two supporting arms 38 and 39 of the middle form 37.

Figure 10:
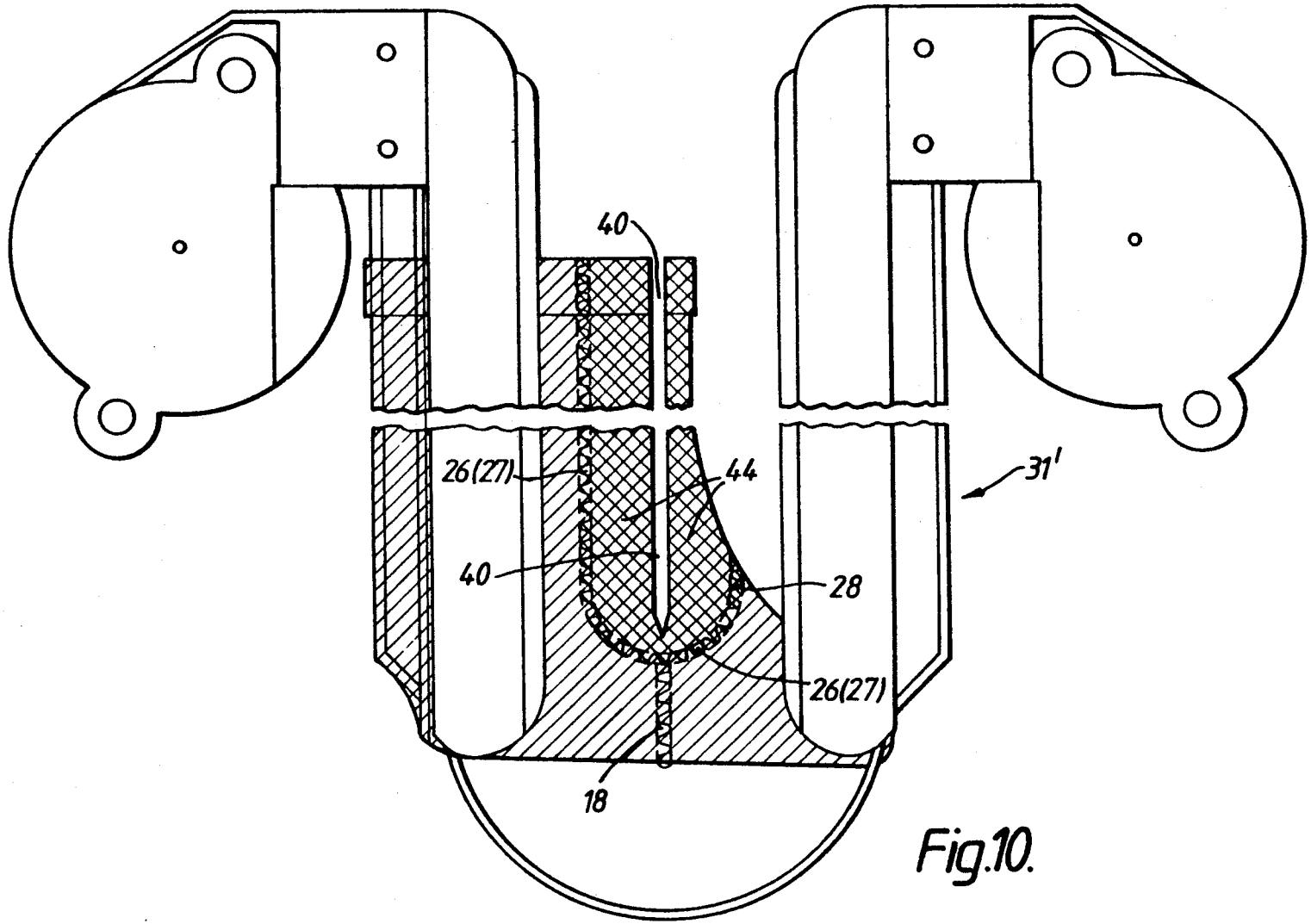
FIG. 10 shows a plan view corresponding to FIG. 9 in which are drawn a separating cut made with a cutting device and a subsequent seam connecting the half comfort gusset to the two stocking portions of the pair of tights.

At the processing station B, a separating cut 40 designated in FIG. 10 is taken through both stocking portions 11, 21 and 12, 22 and through the interposed comfort gusset 13, 23. Cut 40 ends shortly before the closing seam 18 of the comfort gusset 13, 23. The cut is made by means of the cutting device 32. At the processing station C, the two supporting arms 38, 39 of all three forms 35–37 are swung apart so that the cut edges formed are suitably exposed for seaming. The cut edges extend generally parallel to inner longitudinal edges of the arms which, when spread apart include a shallow obtuse angle as will appear from FIG. 5. At the processing station D, the connecting seam 16 visible from FIG. 1 is then formed between a cut edge of the comfort gusset 13 and a cut edge of the one stocking portion 11, by means of the sewing device 33, while at the following processing station E, the connecting seam 17 between a cut edge of the comfort gusset 13 and a cut edge of the other stocking portion 12 is formed by means of the sewing device 34.

Figure 8:
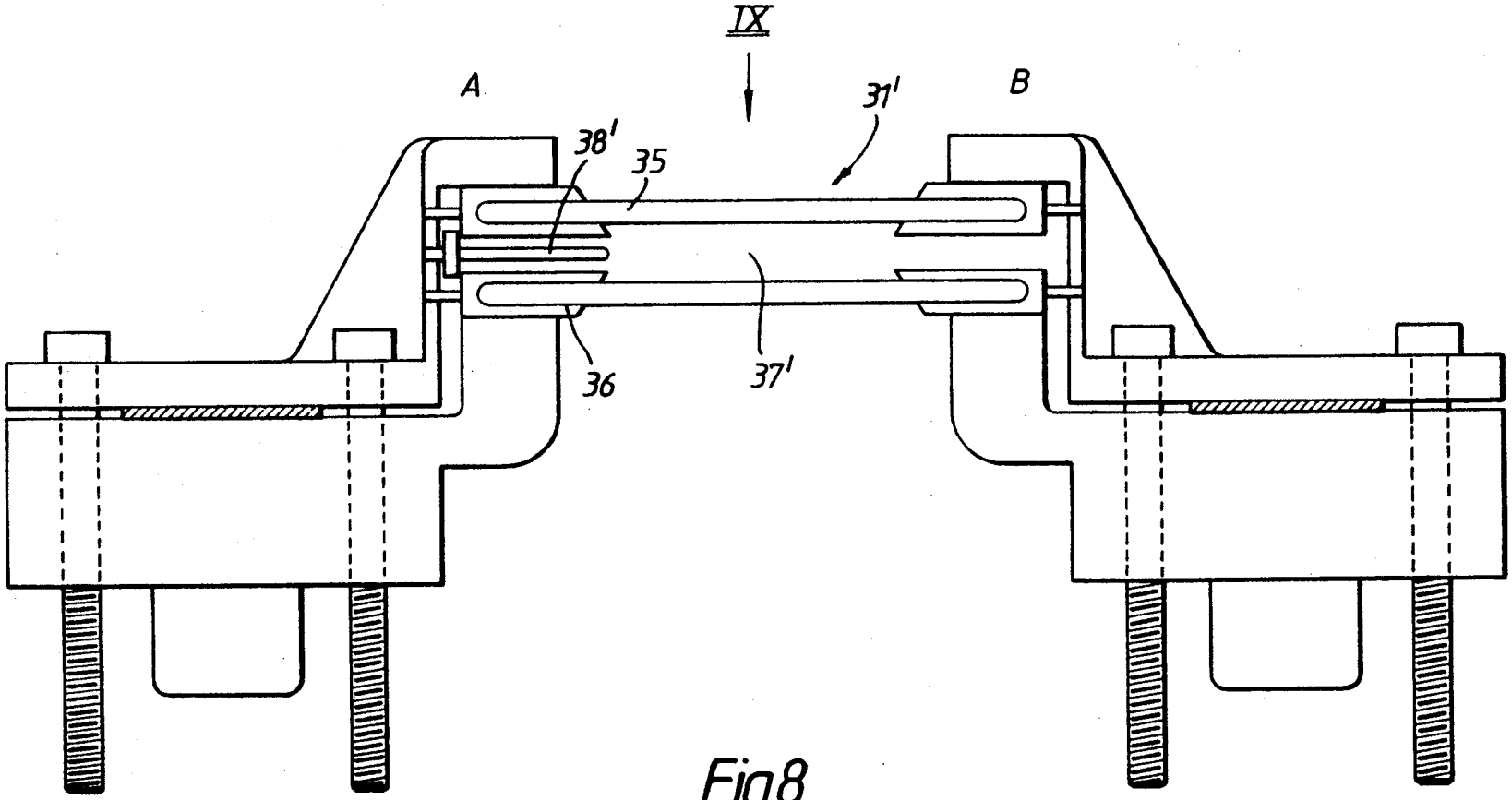
FIG. 8 shows a front view of a set of forms of apparatus, according to the invention, suitable for incorporating a half comfort gusset.
Figure 9:
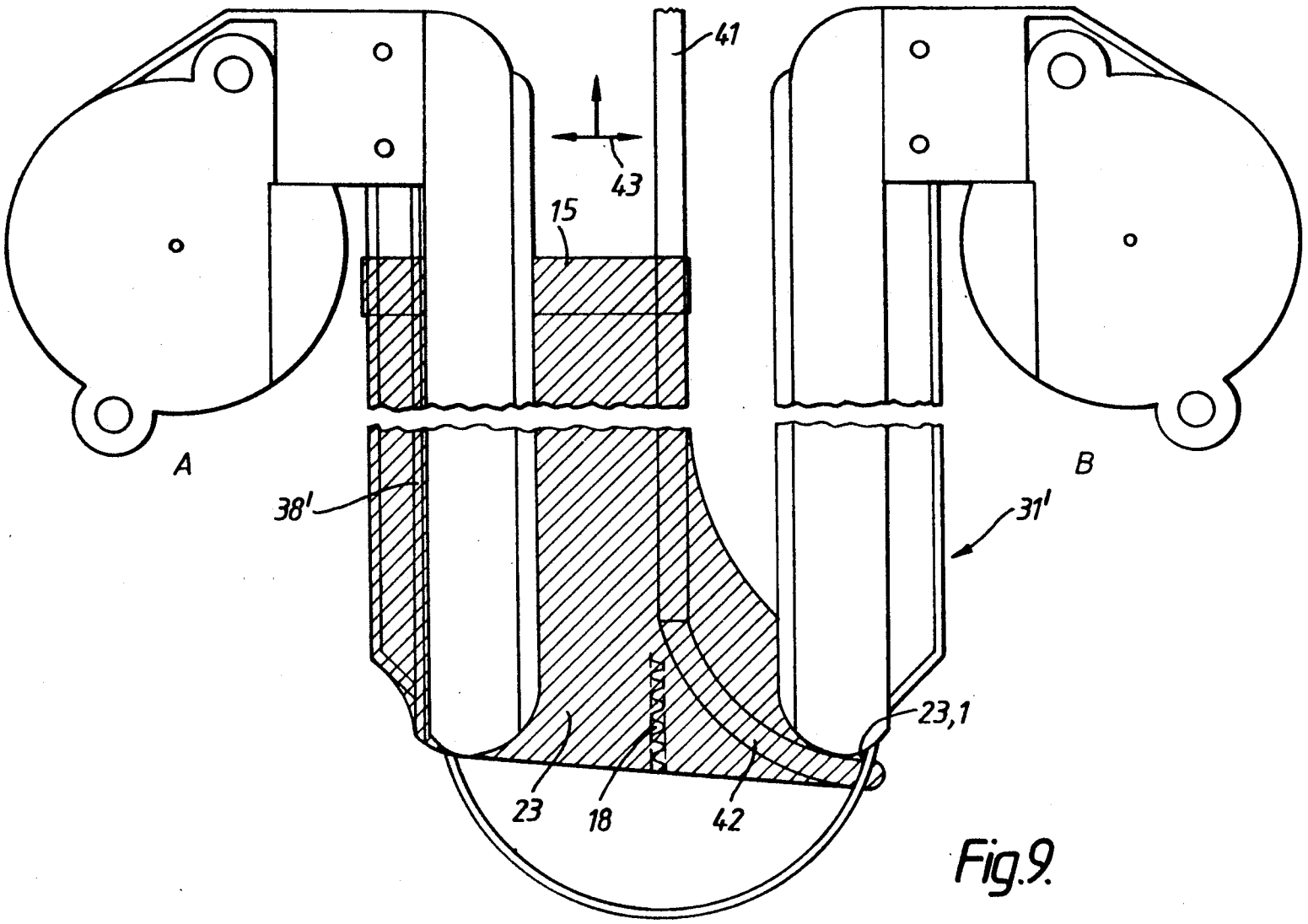
FIG. 9 shows a plan view of the set of forms according to FIG. 8 with a tubular prefabricated comfort gusset pulled thereon.

FIGS. 8 to 10 show a set of forms 31' which is adapted for the machine sewing of a pair of tights 20 according to FIG. 2. The upper form 35 and the lower form 36 of the set of forms 31' have the same construction as the set of forms 31 and again serve to stretch the two stocking portions 21 and 22 (FIG. 2). The interposed third form 37' is for pulling on the comfort gusset 23, and has a supporting arm 38' at one side only. A similar supporting arm is lacking at the other side. Instead, a stretching arm 41 with a cranked end portion 42, e.g. curved as in the shape of a sickle or hockey stick, is provided which is movable in the plane of the form in the direction of the arrow 43, by means of a drive device not illustrated, and forms part of the processing station A. With its shaped end portion 42, a front end region 23.1 of the tubular prefabricated comfort gusset 23 can be pushed in between the supporting arms of the upper and lower forms 35, 36 to be gripped thereby as can be seen from FIG. 9. Then the stretching arm 41 is withdrawn from the set of forms and the set of forms 31′ is moved onwards to the processing station B where the separating cut 40 seen in FIG. 10 is made. In FIG. 10, one of the connecting seams 26, 27 is drawn which are subsequently formed, after the supporting arms of the set of forms 31′ have been swung apart, at the processing stations D and E while simultaneously with the formation of this seam the regions 44, which are cross-hatched in FIG. 10, of the tubular prefabricated comfort gusset 23 are cut off as waste. This waste can be removed for example by conventional cutters associated with cutting and sewing machines provided at stations D and E and numbered 33 and 34 in FIG. 5. Alternatively, and in some cases preferably, regions 44 can be removed by means of a separate cutting device forming an additional processing station introduced upstream of station D.

It will be appreciated that the foregoing description is given by way of example only. Variations and modifications will occur to the addressee such as are within the spirit and scope of the invention and such are intended to be within the ambit of the appended claims which should be construed accordingly.

I claim:

1. A method for the machine sewing of a pair of tights having a comfort gusset extending at least from the crotch over the seat portion and to the waistband of said tights, comprising the following successive steps:

a) prefabricating a comfort gusset in the form of a tubular knitted part having an end band portion;

b) closing the end of the tubular knitted part remote from said end band portion by means of a closing seam;

c) pulling the tubular comfort gusset onto a form disposed between two other forms each of said two other forms receiving a stocking portion of the pair of tights in such a manner that said closing seam extends partially in a plane perpendicular to the longitudinal planes of said forms which are parallel to one another; and d) subsequently seaming the stocking portions to the comfort gusset after a previous partial cutting of each of said gusset and said stocking portion.

2. A method according to claim 1, wherein the following steps are performed after step c):

d) joint cutting open of both stocking portions and the comfort gusset arranged therebetween, along a cutting line which terminates shortly before the closing seam;

e) swinging open arms of said forms while gripping cut parts there-between;

f) successively seaming together of one cut edge of said comfort gusset to cut edges of one stocking portion and of another cut edge of said comfort gusset to cut edges of the other stocking portion to form seams.

3. A line closing and gussetting apparatus for machine sewing of a pair of tights having a tubular prefabricated comfort gusset comprising a plurality of processing stations located along a predetermined path, at least one pair of forms for holding two prefabricated tubular stocking leg portions of the tights and adapted for movement past said stations, at least one of said stations comprising a cutting device and at least one station a sewing device, and a third form disposed between said two forms, said third form being adapted to hold the tubular prefabricated comfort gusset and being arranged for joint movement with said other two forms past said station for partial cutting of said gusset and said stocking leg portions and sewing said cut gusset to both of said leg portions to form said tights.

4. An apparatus as defined in claim 3 wherein the third form is copivotable with the first two forms and receives the prefabricated gusset thereon.

5. A line closing and gussetting apparatus as defined in claim 3 wherein said third form has a stretching arm associated therewith and moveable in the same plane thereof, said third form and said stretching arm adapted to receive a half comfort gusset thereover.

6. An apparatus according to claim 5, wherein said stretching arm has an end portion which is cranked and has a rounded free end.

7. An apparatus according to claim 3, wherein the processing station provided with said cutting device is followed by first and second processing stations each provided with a seaming device, and at the first station, a seam can be formed between a cut edge of said comfort gusset and at least one cut edge of one stocking leg portion and at the second station a seam can be formed between another cut edge of said comfort gusset and at least one cut edge of said other stocking leg portion.

8. An apparatus according to claim 3, wherein disposed between the processing station comprising said cutting device and the first station comprising a seaming device is a separate cutting device which in use acts only on said comfort gusset arranged on said third form.

9. An apparatus as defined in claim 3 comprising further said cutting device located along said path is adapted for travel for performing said partial cutting operation on both said leg portions and said comfort gusset.

* * * * *